United States Patent [19]

Gillemot

[11] 4,026,619

[45] May 31, 1977

[54] HIGH CAPACITY SOLDERLESS BONDING ASSEMBLY FOR SHIELDED CABLES

[75] Inventor: George W. Gillemot, Santa Monica, Calif.

[73] Assignee: John T. Thompson, Santa Monica, Calif. ; a part interest

[22] Filed: Dec. 8, 1975

[21] Appl. No.: 638,749

Related U.S. Application Data

[63] Continuation of Ser. No. 506,236, Sept. 16, 1974, abandoned.

[52] U.S. Cl. ..... 339/14 R; 174/51; 174/88 R; 339/95 R; 339/251

[51] Int. Cl.[2] ..... H01R 3/06

[58] Field of Search ..... 339/14 R, 95 R, 97, 339/251; 174/88, 38, 51, 71

[56] References Cited

UNITED STATES PATENTS 3,253,247 5/1966 Vos ..... 339/95 R 3,753,204 8/1973 Thompson ..... 174/88 R X

*Primary Examiner*—Roy Lake
*Assistant Examiner*—DeWalden W. Jones
*Attorney, Agent, or Firm*—Harris, Kern, Wallen & Tinsley

[57] ABSTRACT

An improved high-capacity solderless bonding assembly for shielded cables having a current carrying capacity in the order of 1,000 amperes for in excess of 15 seconds. The assembly includes a U-shaped metal strap of good conductivity material having one leg insertable beneath a cable shield together with strong ferrous metal fastener means extending through aligned openings of the strap legs as well as the cable sheath and shield, and effective to clamp one strap leg against the shield and the other leg to the outer end of the fastener means thereby utilizing the strap and the fastener to share the electrical load. The fastener means extend through aligned openings in the legs of the U-shaped strap and through the cable sheath and shield.

9 Claims, 4 Drawing Figures

HIGH CAPACITY SOLDERLESS BONDING ASSEMBLY FOR SHIELDED CABLES

This is a continuation of application Ser. No. 506,236, filed Sept. 16, 1974 now abandoned.

This invention relates to cable bonding assemblies and more particularly to an improved high-capacity bonding assembly of high mechanical strength and greatly improved current carrying capacity.

To assure fidelity of signals, multiconductor cables widely used to convey communication and low-strength signals must be shielded by a metallic shield jacket customarily located beneath an elastomeric sheath. These shield jackets are required to be grounded. Normally, the currents carried in the cable shield and desired to be grounded are quite small. However, under certain conditions very high amperage currents can be present and these, as well as other currents customarily present, must be grounded. High amperage currents occur, for example, when the cable is struck by lightning or the shield jacket comes in contact with a live power conductor by accident or otherwise. In such circumstances it is of paramount importance that the bonding connection between the cable shield and the ground conductor have adequate current carrying capacity for a substantial period of time. One criteria is the ability of the bonding connection to the cable to safely handle 1,000 amperes for at least 15 seconds.

Such requirements necessitate the use of bonding connections having not only adequate current carrying capacity but the ability to provide a reliable high strength mechanical connection between a heavy gauge grounding conductor and the thin low strength metal shields commonly employed in electrical cables. Various bonding assembly constructions have been proposed heretofore which have been found quite satisfactory to meet the mechanical strength requirements mentioned above but which failed to meet the current carrying requirements because of the excess resistivity property of the clamping bolt.

Heavy aluminum foil is commonly used for the cable shield and the inner surface facing the cable conductors is customarily coated with a thin film of non-conductive material to avoid any possibility of contact with the conductors. Because of these factors it is not feasible to provide a soldered or abrazed connection between the bonding assembly and the shield. It is both costly, time consuming and impractical to attempt removal of the insulating film from the shield. This necessitates some expedient to provide an electrical connection to the cable shield without removing the insulating film, yet capable of providing a highly reliable stable electrical connection of adequate current carrying capacity.

One proposal is that disclosed in U.S. Pat. No. 3,676,836 granted to myself and John T. Thompson on July 11, 1972. That bonding assembly utilizes a resilient metal shim having sharp protrusions capable of puncturing the insulating film on the shield as it is being tightened against the shield by a clamping bolt passing through a slit extending lenghtwise of the shield and cable sheath. This bonding assembly is found quite satisfactory but lacks the requisite current carrying capacity to handle power surges, lightning charges and the like current sometimes present on cable shields.

To overcome the deficiencies of prior bonding constructions and to provide a simple, rugged, high efficiency, low cost bonding assembly there is provided by this invention a bonding assembly having four principal parts comprising inner and outer wide area high strength shoes one of which includes a threaded stud fixed to its midportion, a clamping nut and U-shaped strap of material having excellent conductivity. One leg of the latter has a multiplicity of sharp burrs extending toward the other leg and effective to penetrate an insulating film if present of the inner surface of the cable shield. The two legs have aligned openings adapted to cooperate with the threaded fastener and by which the two shoes and the U-shaped strip are held firmly assembled astride one end of the cable shield and sheath with the fastener extending through the aligned openings in the strap legs and through the cable shield and sheath. In the interests of high strength and economy, the two shoes and the clamping fastener are made of ferrous metal whereas the U-shaped strap is made of copper, aluminum or the like type of excellent conductivity material. The ferrous metal fastener supplements the U-shaped strap in transmitting heavy current flows between the shield and a heavy ground bonding conductor but its principal function is to serve as an inexpensive high strength clamping fastener. The major portion of the charge being grounded is conducted by the U-shaped strap which is sized to carry the heaviest flows required to be handled without substantial change in its resistivity. Attempts to use brass, copper, aluminum or the like high conductivity materials for the clamping fastener are not feasible because lacking adequate strength to withstand the tightening pressures found desirable in bonding practice. Moreover, if these parts are made of sufficiently heavy stock to meet strength requirements the bulk of the assembly is increased objectionably and the cost is excessive and non-competitive in comparison with the solution to the problem provided by this invention.

Accordingly, it is a primary object of this invention to provide a heavy duty high reliability bonding assembly suitable for use with shielded cables and comprising a solderless connection to the cable shield capable of handling a current flow of the order of 1,000 amperes for a minimum period of 15 seconds or more.

Another object of the invention is the provision of an improved high capacity solderless bonding assembly for shielded cables comprising a pair of ferrous clamping shoes and a clamping fastener in combination with a U-shaped heavy duty bonding strap of excellent conductivity.

Another object of the invention is to provide a high capacity high strength solderless bonding assembly comprising a unitary U-shaped strap of high conductive material tightly clamped astride a cable shield and sheath thereby compressing the intervening portions of the sheath and shield and utilizing the U-shaped strap to provide a high conductivity solderless connection between the inwardly facing surface of a cable shield and a heavy duty grounding conductor.

These and other more specific objects will appear upon reading the following specification and claims and upon considering in connection therewith the attached drawing to which they relate.

Referring now to the drawing in which a preferred embodiment of the invention is illustrated:

Figure 1:
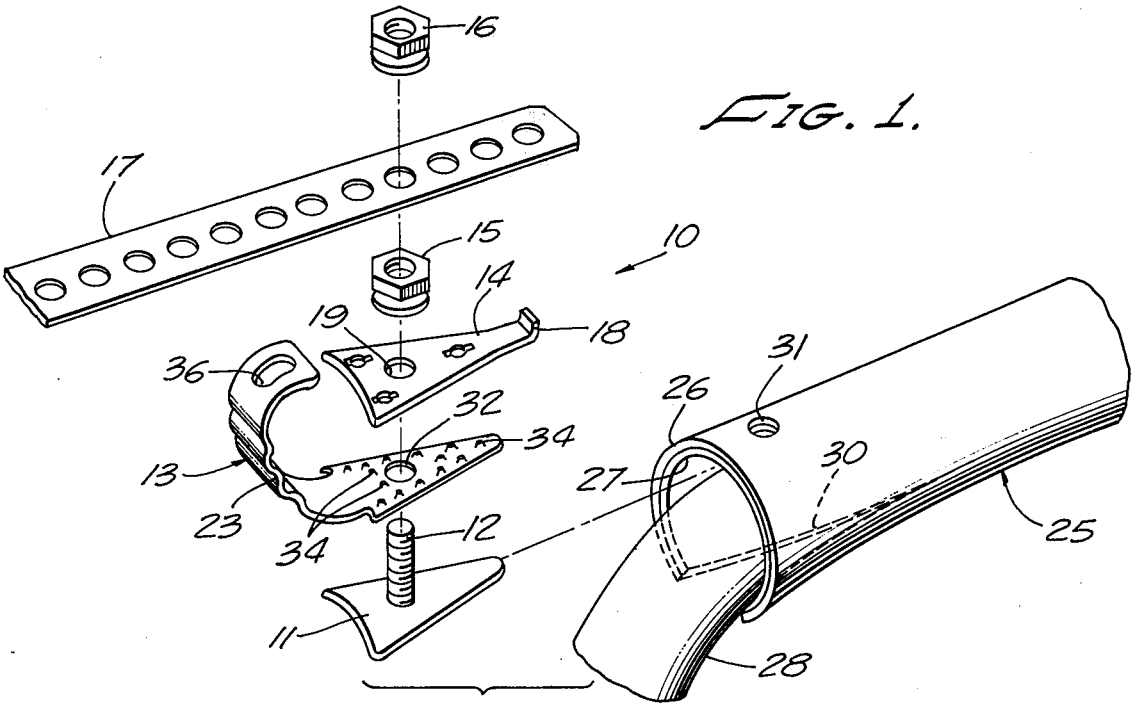
FIG. 1 is an exploded perspective view of an illustrative embodiment of the invention bonding assembly in readiness for assembly to a shielded cable.

Referring now more particularly to FIG. 1 there is shown an illustrative embodiment of the invention bonding assembly designated generally 10. This assembly comprises a rigid inner shoe 11 having a threaded fastener stud 12 rigidly affixed to the central portion thereof, a U-shaped strap 13, an outer shoe 14, and a pair of clamping nuts 15, 16. Also shown is a typical heavy duty grounding conductor 17 customarily employed to connect assembly 10 to a ground stake or pipe. Components 11, 12 and 14 are preferably formed of ferrous material whereas strap member 13 is formed of heavy gauge copper, brass, aluminum or the like high conductivity material as is the grounding conductor 17. Nuts 15 and 16 may also be made of ferrous material.

Both the inner and outer shoes 11, 14 are here shown as elongated and narrower at the forward end than at their heel ends. Both are also preferably similarly arched crosswise along an arc conforming generally to the curvature of the cable sheath with which the assembly is to be used. The narrow forward end of inner shoe 11 facilitates insertion and assembly of this member endwise beneath the end of a cable sheath and shield in a manner which will be described in greater detail presently. One end of the ferrous shank 12 is preferably preformed in frusto-conical shape for a forced driven fit in a similarly shaped opening through shoe 11 and is swaged, welded or otherwise rigidly affixed to the central portion of shoe 11 in known manner. The end of the shank lies generally flush with the adjacent concave surface of the shoe. It will be understood that, in an alternate construction, fastener 12 may be threaded into an insert not shown but affixed to an opening in the center portion of shoe 11. In this event the outer end of the fastener is provided with a kerf or other tool engaging expedient of facilitate assembly of the fastener into the inner shoe after the latter has been inserted beneath the cable shield until its threaded opening registers with the openings made through the sheath to accommodate the threaded shank 12.

Figure 3:
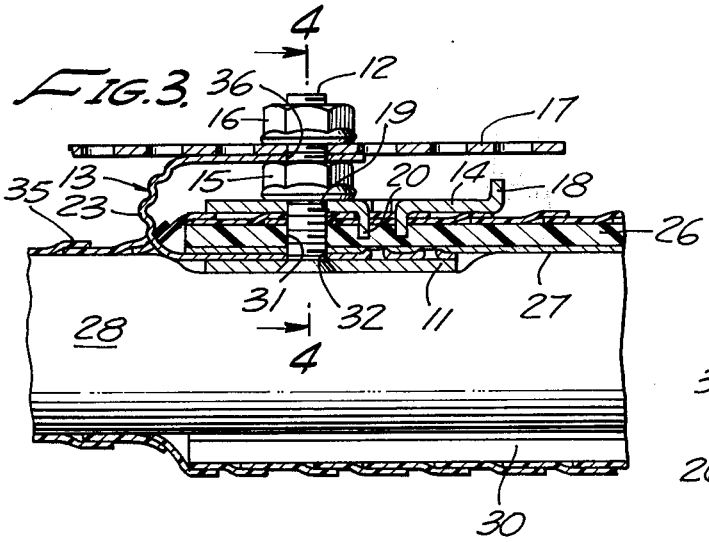
FIG. 3 is a cross-sectional view similar to FIG. 2 showing the bonding assembly fully assembled.
Figure 4:
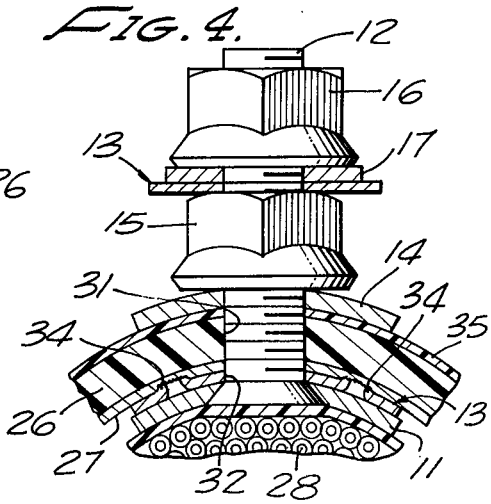
FIG. 4 is a cross-sectional view on an enlarged scale taken along line 4—4 on FIG. 3.

The outer shoe is preferably shaped similarly to the inner shoe but is usually somewhat longer and has an upturned tang 18 at one end spaced sufficiently from the fastener receiving opening 19 to accommodate the width of a clamping band encircling the cable and the outer shoe in the manner disclosed in Thompson and Gillemot Pat. 3,676,836. Outer shoe 14 is also preferably provided with a plurality of inwardly projecting tangs 20 distributed about the fastener receiving opening 19. These tangs are best shown in FIG. 3 and are forced to penetrate into the cable sheath during installation of the bonding assembly. The tangs serve to prevent rotation of the outer shoe and tightening of the clamping nut 15.

The high conductivity strap 13 is formed of ductile material and preferably includes several corrugations 23 crosswise of its bight portion to facilitate flexing of the strap legs toward and away from one another during the assembly operation.

The installation of the bonding assembly is performed as follows. A portion of the elastomeric sheath 26 and shield 27 of a shielded cable 25 is first removed to expose its conductors 28. The sheath and shield are then slit lengthwise of the cable for several inches as it indicated at 30, thereby permitting the conductors 28 to be bent sharply outwardly along the slit and away from the diametrically opposed side of the cable end. Aligned openings 31 are then formed through the sheath and shield in an area spaced substantially inwardly from the end of the sheath. The cable is now in readiness for installation of the bonding assembly.

The opening 32 in the tapered end of strap 13 is than inserted over the threaded shank 12 and this subassembly is inserted endwise into the cable until the free end of the shank can be inserted through openings 31. It will be understood that the inner surface of this leg of strap 13 is provided with a multiplicity of low height sharp edges burrs 34. These burrs are conveniently formed about the rim edge of punch pricks formed through the end of the leg of strap 13 from its outer surface. In consequence, this multiplicity of sharp burrs 34 face toward the inner surface of cable shield 27 and, upon assembly to the cable, these burrs readily cut through any film of insulation possibly present on the shield and penetrate into the body of the shield itself. This penetration occurs during the clamping of the inner lock nut 15 on shank 12.

Figure 2:
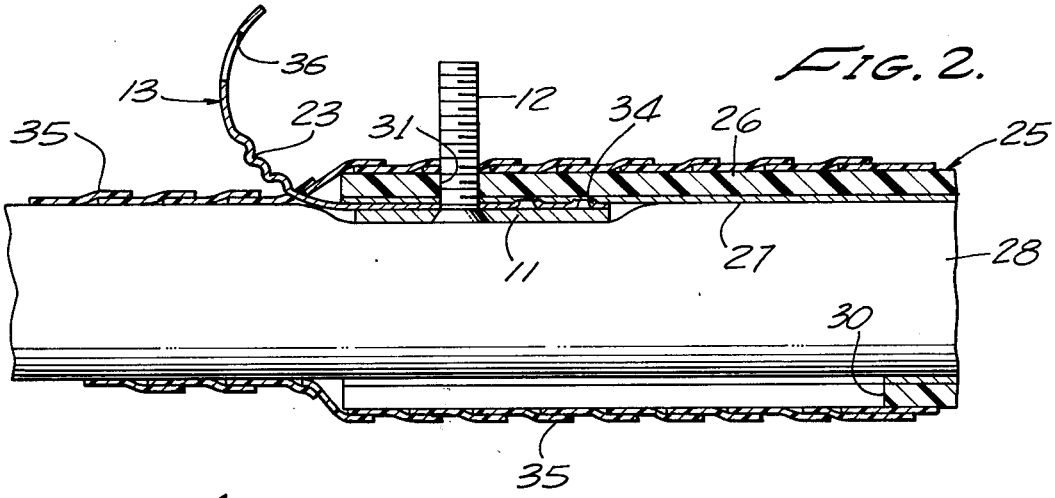
FIG. 2 is a cross-sectional view on an enlarged scale taken longitudinally of a shielded cable during an intermediate stage of the assembly operation.

After the inner shoe and the inner leg of strap 13 have been assembled as described, the cable conductors are straightened into alignment with the main length of the cable and the cable end is tightly served with overlapping convolutions of adhesive tape 35 as is shown in FIG. 2. Thereafter, the outer shoe 14 is assembled over shank 12 with its narrow end overlying the narrow tapered end of inner shoe 11. The first clamping nut 15 is then assembled and tightened causing burrs 34 to penetrate into shield 27 and tangs 20, 20 to penetrate through tape 35 and into the cable sheath in the manner clearly shown in FIG. 3. Thereafter, the elongated opening 36 in outer leg of strap 13 is assembled over shank 12 and the outer clamping nut 15 is used to clamp a suitable heavy duty grounding conductor, such as strap 17, against the surface of the outer leg of strap 13 thereby completing the assembly operation.

From the foregoing it will be clear that the completed bonding assembly utilizes the high strength of shoes 11, 14 and of fastener parts 12, 15 to compress a large area of the cable sheath and shield between the wide area surfaces of the inner and outer shoes. This compression also includes using the two shoes to hold the inner leg of strap 13 in high pressure wide area surface contact with the cable shield. As is well known, elastomeric cable sheaths are extremely tough and strong. It follows that the sandwiching of the shield 27 between one leg strap 13 and sheath 26 provides an excellent electrical connection to the shield via the multiplicity of sharp burrs 34 while at the same time utilizes the strength of the sheath to provide a very strong mechanical connection of the bonding assembly to the shield without risk of injury or damage to the shield. These important objectives are further served by the fact that the fastener extends through the aligned openings 31 in the shield and sheath.

It will be recognized from the foregoing that a double conductive path is provided between the cable shield and grounding conductor 17. One path includes the inner leg of strap 13, inner shoe 11, threaded shank 12 and the two clamping nuts 14, 15. A second and far more effective and efficient high capacity path is provided by the two legs of strap 13 the inner one of which is in direct contact with shield 27 over a wide area and the second one of which is in direct high pressure contact with grounding strap 17. The two conductive paths are found to have a highly satisfactory and acceptable current carrying capacity of 1,000 amperes for a period of at least 15 seconds without risk of damage to the cable shield or to the bonding assembly and without degrading the future current carrying capability of this bonding assembly.

While the particular high capacity solderless bonding assembly for shielded cables disclosed in detail is fully capable of attaining the objects and providing the advantages hereinbefore stated, it is to be understood that it is merely illustrative of the present preferred embodiment of the invention and that no limitations are intended to the detail of construction or design herein shown other than as defined in the appended claims.

I claim:

1. A cable bonding assembly for use in making a dual-conductive-path connection to the shield of a shielded and sheathed cable, wherein the cable shield is located inwardly of the cable sheath, including:

a. an inner conductive shoe insertable under the cable shield;

b. a threaded conductive fastener having an inner end securable to said inner shoe;

c. a generally U-shaped conductive strap having an inner leg provided with an aperture to receive said threaded fastener and insertable under the cable shield between the cable shield and said inner shoe;

d. an outer conductive shoe having an aperture to receive said threaded fastener and adapted to overlie the cable sheath;

e. inner conductive nut means threadable on said threaded fastener outwardly of said outer shoe and adapted to clamp said outer shoe against the cable sheath and to cause said inner shoe to clamp said inner leg of said generally U-shaped strap against the cable shield;

f. said generally U-shaped strap having an outer leg provided with an aperture to receive said threaded fastener outwardly of said inner nut means; and g. outer nut means threadable on said threaded fastener outwardly of said outer leg of said generally U-shaped strap to clamp outer leg against said inner nut means.

2. A cable bonding assembly according to claim 1 including a conductive grounding strap having an aperture to receive said threaded fastener and insertable between said outer leg of said generally U-shaped strap and said outer nut means.

3. A cable bonding assembly as set forth in claim 2 wherein the surface of said inner leg of said generally U-shaped strap which is engageable with the cable shield is burred.

4. A cable bonding assembly according to claim 3 wherein said inner and outer shoes and said inner leg of said generally U-shaped strap are transversely arched.

5. A cable bonding assembly providing a dual-conductive-path connection to the shield of a shielded and sheathed cable, wherein the cable shield is located inwardly of the cable sheath, including:

a. an inner conductive shoe inserted under the cable shield;

b. a threaded conductive fastener having an inner end secured to said inner shoe;

c. a generally U-shaped conductive strap having an inner leg provided with an aperture receiving said threaded fastener and inserted under the cable shield between the cable shield and said inner shoe;

d. an outer conductive shoe having an aperture receiving said threaded fastener and overlying the cable sheath;

e. inner conductive nut means threaded on said threaded fastener outwardly of said outer shoe and clamping said outer shoe against the cable sheath and causing said inner shoe to clamp said inner leg of said generally U-shaped strap against the cable shield;

f. said generally U-shaped strap having an outer leg provided with an aperture receiving said threaded fastener outwardly of said inner nut means; and g. outer nut means threaded on said threaded fastener outwardly of said outer leg of said generally U-shaped strap and clamping said outer leg against said inner nut means.

6. A cable bonding assembly according to claim 5 including a conductive grounding strap having an aperture receiving said threaded fastener and inserted between said outer leg of said generally U-shaped strap and said outer nut means.

7. A cable bonding assembly as set forth in claim 6 wherein the surface of said inner leg of said generally U-shaped strap which engages the cable shield is burred.

8. A cable bonding assembly according to claim 7 wherein said inner and outer shoes and said inner leg of said generally U-shaped strap are transversely arched.

9. A cable bonding assembly for use in making a dual-conductive-path connection to the shield of shielded and sheathed cable, wherein the cable shield is located inwardly of the cable sheath, including:

a. inner conductive shoe means insertable under the cable shield and adapted to make electrical contact therewith;

b. a threaded conductive fastener having an inner end securable to said inner shoe means in electrical contact therewith to form a first conductive path from the shield to said threaded fastener;

c. an outer shoe having an aperture to receive said threaded fastener and adapted to overlie the cable sheath;

d. nut means threadable on said threaded fastener outwardly of said outer shoe and adapted to clamp the cable sheath and shield between said outer shoe and said inner shoe means; and e. separate conductive means, independent of said outer shoe, for electrically connecting the shield to said threaded fastener outwardly of the cable sheath to provide a second conductive path from the shield to said threaded fastener.

* * * * *